United States Patent [19]

Schäfer

[11] 4,312,208

[45] Jan. 26, 1982

[54] FOUR-ROLLER BENDING AND ROUNDING MACHINE

[75] Inventor: August W. Schäfer, Wilnsdorf-Wilden, Fed. Rep. of Germany

[73] Assignee: Wilhelm Schäfer Maschinenbau, Wilnsdorf-Wilden, Fed. Rep. of Germany

[21] Appl. No.: 82,623

[22] Filed: Oct. 9, 1979

[30] Foreign Application Priority Data

Nov. 4, 1978 [DE] Fed. Rep. of Germany ..... 2847965

[51] Int. Cl.[3] ..... B21B 13/14; B21B 15/00; B21D 13/04

[52] U.S. Cl. ..... 72/166; 72/241; 72/110

[58] Field of Search ..... 72/110, 68, 111, 169–175, 72/163, 241, 166, 167

[56] References Cited

U.S. PATENT DOCUMENTS

| | | | |
|---|---|---|---|
| 518,765 | 4/1894 | Plecker | 72/175 |
| 965,018 | 7/1910 | Saunders | 72/175 |
| 2,043,665 | 6/1936 | Iversen et al. | 72/169 |

FOREIGN PATENT DOCUMENTS

| | | | |
|---|---|---|---|
| 428482 | 5/1926 | Fed. Rep. of Germany | 72/169 |
| 510894 | 10/1930 | Fed. Rep. of Germany | 72/175 |
| 549317 | 4/1932 | Fed. Rep. of Germany | 72/166 |
| 862287 | 1/1953 | Fed. Rep. of Germany | 72/170 |
| 960090 | 3/1957 | Fed. Rep. of Germany | 72/170 |
| 1085839 | 1/1961 | Fed. Rep. of Germany | 72/166 |
| 1602489 | 12/1973 | Fed. Rep. of Germany . | |
| 627995 | 11/1961 | Italy | 72/169 |
| 49-35265 | 4/1974 | Japan | 72/166 |
| 227860 | 10/1925 | United Kingdom | 72/170 |

*Primary Examiner*—Lowell A. Larson
*Attorney, Agent, or Firm*—Karl F. Ross

[57] ABSTRACT

A tube-making machine has a pair of axially spaced end supports between which upper and lower bending rollers extend axially. These rollers have ends journaled in the supports with the upper roller vertically limitedly displaceable in the support and the lower roller vertically nondisplaceable. A pair of axially extending side rollers horizontally flanking the upper and lower rollers have ends also journaled and vertically limitedly displaceable in the supports. A C-shaped rigid member lying generally in a plane between the supports and perpendicular to the axes of the rollers has rigid upper and lower arms respectively juxtaposed with the upper and lower bending rollers. Respective upper and lower support rollers are urged by respective upper and lower hydraulic cylinders respectively downwardly and upwardly into engagement with the upper and lower bending rollers at the plane to prevent deflection of these rollers during operation of the machine for bending or crimping. The C-shaped member with the support rollers can be pivoted between a position embracing the upper and lower rollers as described above and a position offset therefrom to allow rounding of a tubular workpiece by the machine.

5 Claims, 1 Drawing Figure

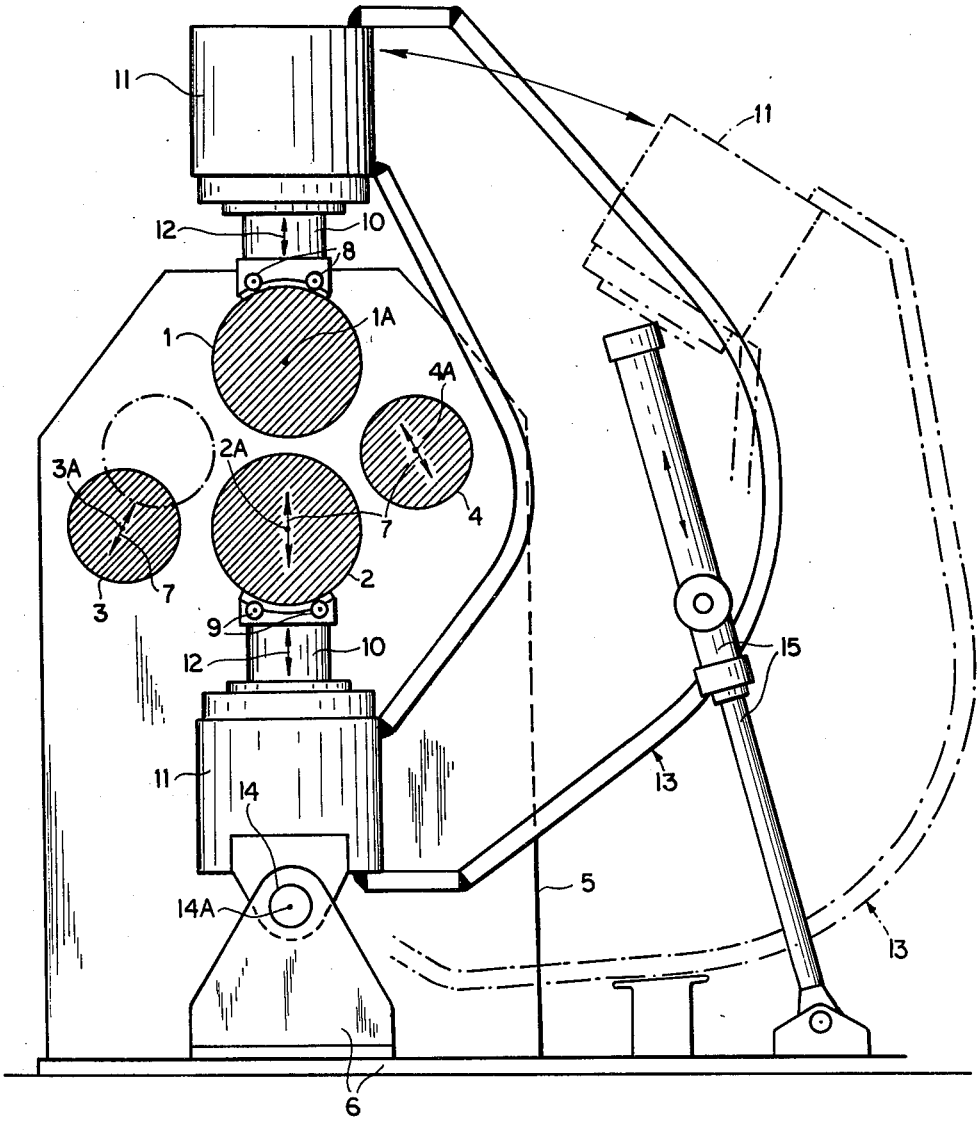
11
11
12
10
8
1
1A
4A
3A
2A
7
4
3
7
2
9
12
10
15
11
14
13
14A
5
13
6

FOUR-ROLLER BENDING AND ROUNDING MACHINE

FIELD OF THE INVENTION

The present invention relates to a four-roller bending or tube-making machine. More particularly this invention concerns an arrangement for reducing deflection of the rollers in such a machine.

BACKGROUND OF THE INVENTION

A four-roller tube-making machine is known having a pair of axially spaced end supports in which are journaled the ends of upper and lower large-diameter bending rollers. Normally the ends of the lower rollers are limitedly axially displaceable in the end supports. Furthermore a pair of small-diameter side rollers horizontally flank the upper and lower rollers and have ends journaled and limitedly displaceable in the end supports. Such an arrangement is used for bending or crimping plate stock, and can be employed for smoothing a large-diameter pipe formed by closing and welding the crimped plate stock.

It is known from German Pat. No. 428,482 to provide so-called support rollers for the lower roller. These support rollers can bear upwardly on the lower bending roller and can normally be moved along an axially extending track or rail of the machine.

German Pat. No. 960,090 has upper support rollers downwardly effective on the upper bending roller, and mounted on an axially extending traverse or rail whose ends are releasably mounted on the end supports. This traverse is in the way during smoothing of a tube, during which operation the radial forces effective on the bending rollers are considerably less than during bending or crimping. Thus it is necessary to use a different machine to round or smooth a closed and welded tube.

As the known systems of supporting the bending rollers other than at their ends cannot be employed in many applications, it is possible to substantially overdimension the machine so that even without such intermediate support it is possible for the rollers to exert the necessary forces on the workpiece during crimping or bending. Such overdimensioning obviously leads to increased equipment costs and operating expenses.

OBJECTS OF THE INVENTION

It is therefore an object of the present invention to improve on the known four-roller tube-bending and rounding machine.

Another object is to provide a rounding machine wherein it is possible to provide extra central support for the rollers for bending.

SUMMARY OF THE INVENTION

These objects are attained according to the instant invention in a four-roller bending machine of the above-described type which has an improvement comprising a C-shaped rigid member which lies in and is movable in a plane between the supports and perpendicular to the axes of the rollers. This C-shaped rigid member has rigid upper and lower arms respectively juxtaposed with the upper and lower bending rollers. Respective upper and lower support rollers are vertically displaceably mounted on the upper and lower arms and means is provided for urging these upper and lower support rollers respectively downwardly and upwardly into engagement with the upper and lower bending rollers at the plane to prevent deflection of the bending rollers.

With the system according to the instant invention, therefore, much of the forces that have to be withstood by the bending rollers will be brought to bear on the C-shaped member holding the support rollers for the upper and lower bending rollers. The end supports for the bending rollers will therefore be spared this excessive stress and will not have to be overdimensioned. Such construction, therefore, makes a four-roller machine of predetermined dimensions able to carry out tasks normally only possible for substantially larger machines, such as the smoothing or rounding of a welded pipe.

According to further features of this invention the upper and lower arms are provided with respective upper and lower hydraulic cylinders carrying the respective upper and lower support rollers. Two such upper and two such lower support rollers are provided so that the system automatically centers itself. Furthermore, the C-shaped member is pivotal about an axis lying in a plane defined by the axes of the upper and lower bending rollers, and lying below these bending rollers. Another hydraulic cylinder can pivot the entire C-shaped member with the support rollers between an upright position in which the support rollers can be brought to bear on the respective bending rollers and a retracted position where the entire mechanism is completely out of the way of the system. In this second position it is therefore possible to use the four-roller machine on a piece of large-diameter tubing, but the flat plate to form such tubing can be fed in with the C-shaped member in the operative position, as when the bending operation starts it is necessary to bear with considerably greater force on the workpiece.

BRIEF DESCRIPTION OF THE DRAWING

The sole FIGURE of the drawing is a vertical section through the machine according to this invention.

SPECIFIC DESCRIPTION

As shown in the drawing a four-roller bending press of the type described generally in the above-cited German patents has an upper large-diameter bending roller 1, a lower vertically displaceable bending roller 2, and two side bending rollers 3 and 4 flanking the rollers 1 and 2. The rollers 1, 2, 3 and 4 are centered on parallel axes 1A, 2A, 3A and 4A. The roller 1 is journaled in such a manner that the axis 1A cannot move in end supports 5. On the contrary the rollers 2, 3 and 4 have their ends journaled in the supports 5 so that they can move in the directions of arrows 7.

A pair of small-diameter upper support rollers 8 and a pair of similar lower support rollers 9 bear oppositely downwardly and upwardly on the upper roller 1 and lower roller 2. These pairs of rollers 8 and 9 are carried on respective piston rods 10 of rams 11 carried on the end of a C-shaped arm 13 so that the rollers 8 and 9 can be displaced vertically in the plane of the axes 1A and 2A as illustrated by arrows 12. The entire rigid C-shaped member 13 is formed as a steel boxbeam or the like and is povoted on a horizontal axle 14 on a stationary base 6. The axle 14 defines an axis 14A coplanar with and parallel to axes 1A and 2A. A hydraulic ram 15 allows the entire C-shaped member 13 to be pivoted between the bending position indicated in solid lines and the rounding position indicated in dot-dash lines.

For light-duty operation such as smoothing or rounding a welded tube the cylinders 11 are depressurized and the cylinder 15 is actuated to withdraw the entire assembly to the dot-dash line position. When, however, the forces to which the rollers 1 and 2 are to be subjected are substantially greater than the forces that the end supports 5 can withstand, as during bending and crimping plate stock to make a large-diameter pipe, the arrangement is pivoted into the solid line position and the cylinders or rams 11 are pressurized so that deflection of the rollers 1 and 2, that is bending away from each other at their centers, is countered.

I claim:

1. In a bending machine having a pair of axially spaced end supports, upper and lower axially extending bending rollers having ends journaled in said supports with said lower roller vertically limitedly displaceable in said supports and said upper roller vertically nondisplaceable in said supports, and a pair of axially extending side rollers horizontally flanking said upper and lower rollers and having ends journaled and vertically limitedly displaceable in said supports, the improvement comprising:

a C-shaped rigid member lying generally in a plane generally equidistant between said supports and perpendicular to the axes of said rollers and having rigid upper and lower arms respectively juxtaposed with said upper and lower bending rollers;

respective upper and lower support rollers vertically displaceably mounted on said upper and lower arms;

means including respective upper and lower hydraulic cylinders on said arms of said member for urging said upper and lower support rollers respectively downwardly and upwardly into engagement with said upper and lower bending rollers at said plane for preventing deflection of said bending rollers; and means for pivotally displacing said member and said support rollers generally in said plane about a horizontal member axis below and generally parallel to the roller axes relative to said bending rollers and supports, whereby said member with said cylinders and support rollers can be pivoted out of the way for use of said machine in bending and rounding a tube.

2. The improvement defined in claim 1 wherein said support rollers are substantially smaller than said bending rollers and include two upper support rollers and two lower support rollers angularly offset to each other with respect to the axis of the respective bending roller.

3. The improvement defined in claim 2 wherein said means for displacing includes a hydraulic cylinder.

4. The improvement defined in claim 2 wherein said rigid member is pivotal about said member axis between a position with said support rollers vertically aligned with said upper and lower bending rollers and a position with said support rollers spaced horizontally from said upper and lower bending rollers.

5. The improvement defined in claim 1 wherein said member axis is generally coplanar with the axes of said upper and lower bending rollers.

* * * * *